US006305674B1

(12) United States Patent
Koivurova

(10) Patent No.: US 6,305,674 B1
(45) Date of Patent: Oct. 23, 2001

(54) SPRING ARTICULATION STRUCTURE

(75) Inventor: Markku Koivurova, Rovaniemi (FI)

(73) Assignee: Lappset Group Oy, Rovaniemi (FI)

( * ) Notice: Subject to any disclaimer, the term of this patent is extended or adjusted under 35 U.S.C. 154(b) by 0 days.

(21) Appl. No.: 09/316,317

(22) Filed: May 21, 1999

(30) Foreign Application Priority Data

Jun. 3, 1998 (FI) ..... 981255

(51) Int. Cl.[7] ..... F16M 1/00

(52) U.S. Cl. ..... 267/136; 267/141; 267/153; 472/135

(58) Field of Search ..... 267/141, 153, 267/136, 201, 279, 280; 188/129; 248/560, 562, 634, 673; 403/132, 133, 135, 137; 472/102, 103, 135, 14

(56) References Cited

U.S. PATENT DOCUMENTS 3,226,142 * 12/1965 Herbenar ..... 403/135
3,574,369 * 4/1971 Andrew ..... 403/132
3,693,999 * 9/1972 Wood, Jr. ..... 403/133
3,837,610 9/1974 Ewers ..... 248/374
4,154,544 * 5/1979 Gair ..... 403/133
4,386,869 * 6/1983 Smith ..... 403/39
4,712,940 * 12/1987 Wood, Jr. ..... 403/133
5,149,067 * 9/1992 Fruhauf et al. ..... 267/140.13
5,816,731 * 10/1998 Howard ..... 403/132

FOREIGN PATENT DOCUMENTS 1 586 527 3/1981 (GB) .

* cited by examiner

*Primary Examiner*—Robert J. Oberleitner
*Assistant Examiner*—Mariano Sy
(74) *Attorney, Agent, or Firm*—Greenberg Traurig LLP

(57) ABSTRACT

A spring articulation structure particularly for play, fitness training and sports instruments, said structure comprising a core element (1) supported in between two rubber rings (2) and provided with a shaft element (5) fitted in said core element; a shell compactly surrounding the core element and the rubber rings and attached to a bottom plate (9), the top part (3') of said shell being in the middle provided with a aperture (8) with a downwardly narrowing conical surface (7) for the shaft element (5); and a cylindrical element (4) resting on top of the top part (3') of the shell and surrounding the shaft element (5).

17 Claims, 6 Drawing Sheets

SPRING ARTICULATION STRUCTURE

The present invention relates to an articulation structure serving as a spring, which structure is suitable to be employed for instance in equipment used in fitness training, sports and children's plays.

Children's playgrounds and parks often include play equipment where various springs are used in order to create a rocking motion, for example play animals that can be rocked back and forth, so that the child is seated on top of said animal. The elastic springs that allow the rocking motion in these instruments must be wearresistant and safe.

For example the U.S. Pat. No. 3,837,610 introduces a resilient pivotal structure suited to be used in playground equipment and including elongate rubber elements, on top of which the pivotal structure is supported. By means of said arrangement, there are created play instruments that can be rocked back and forth while the rubber element serves as the spring. However, the resilient spring structure described in said U.S. patent is a closed structure and hence very difficult to be properly maintained. By means of the arrangement to be introduced in the present invention, there is now achieved a spring articulation structure which can be easily opened for maintenance and whereby the play instrument can be freely rocked in any direction.

Thus the object of the present invention is to realize a spring articulation structure for play, fitness training and sports instruments, which structure can be freely and flexibly inclined to any direction. Another object of the invention is to realize a flexible articulation structure for play, fitness training and sports instruments, which structure is safe and wear-resistant as well as easily installed and maintained. Yet another object of the invention is to realize a spring articulation structure which is simple and economic to manufacture and can be employed in several different applications. These objects are achieved by means of the spring articulation structure of the present invention, and the essential novel features of said invention are described in the appended claims.

Figure 1:
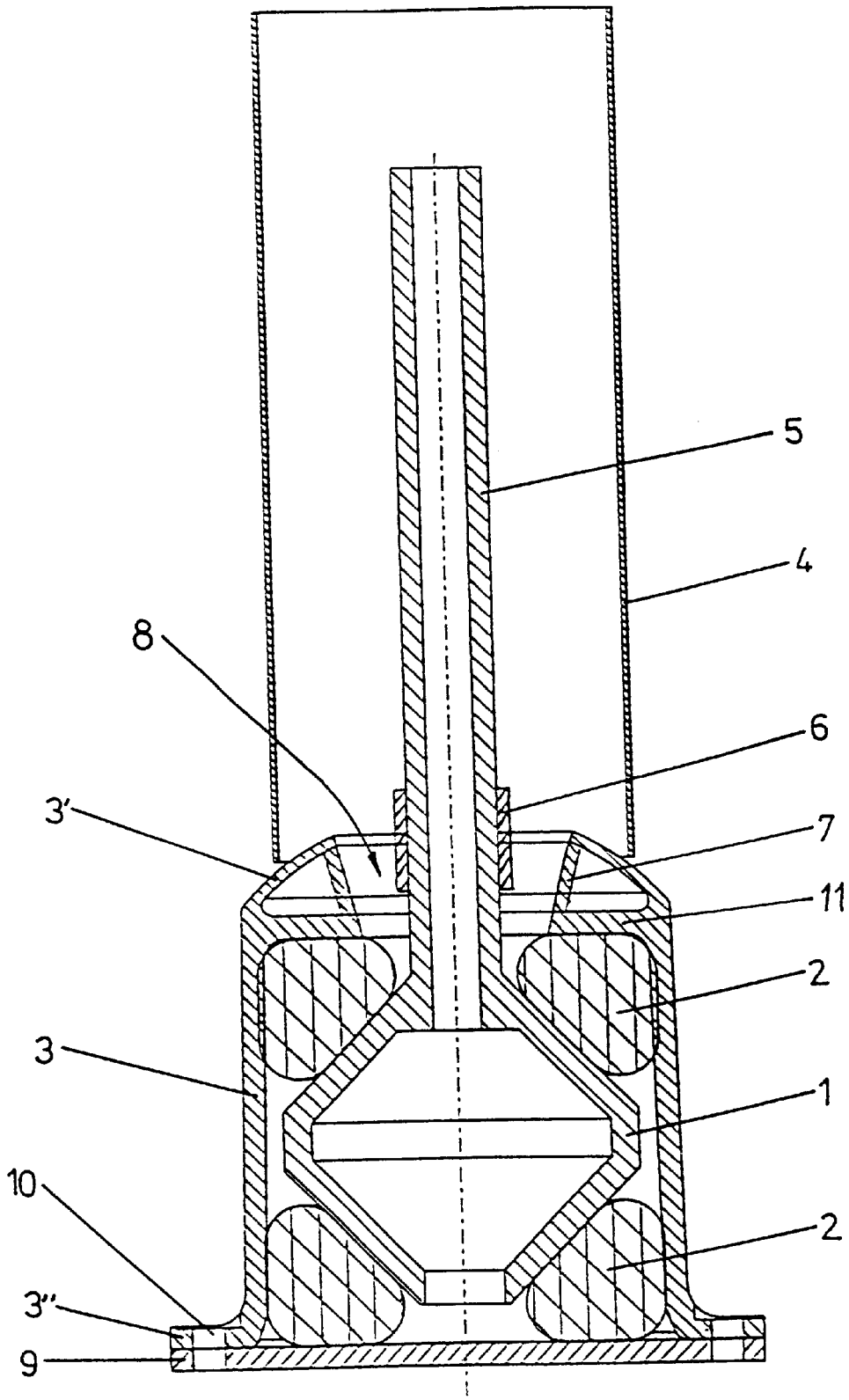
Figure 2:
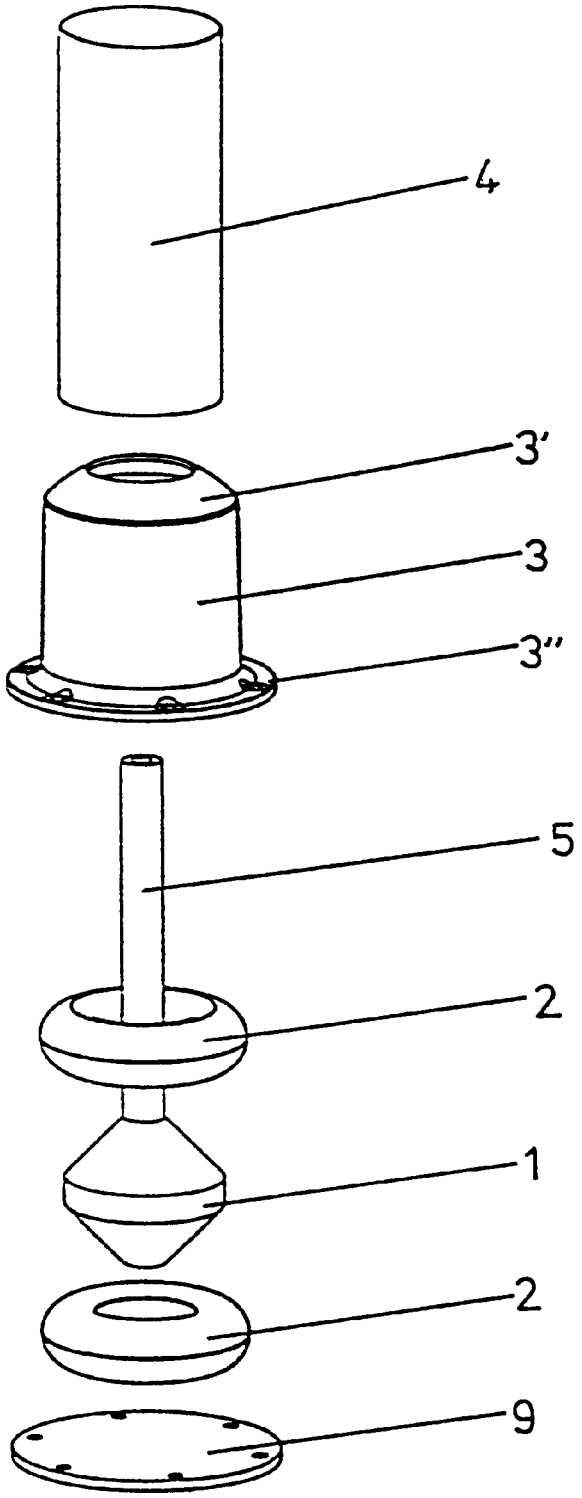
Figure 3:
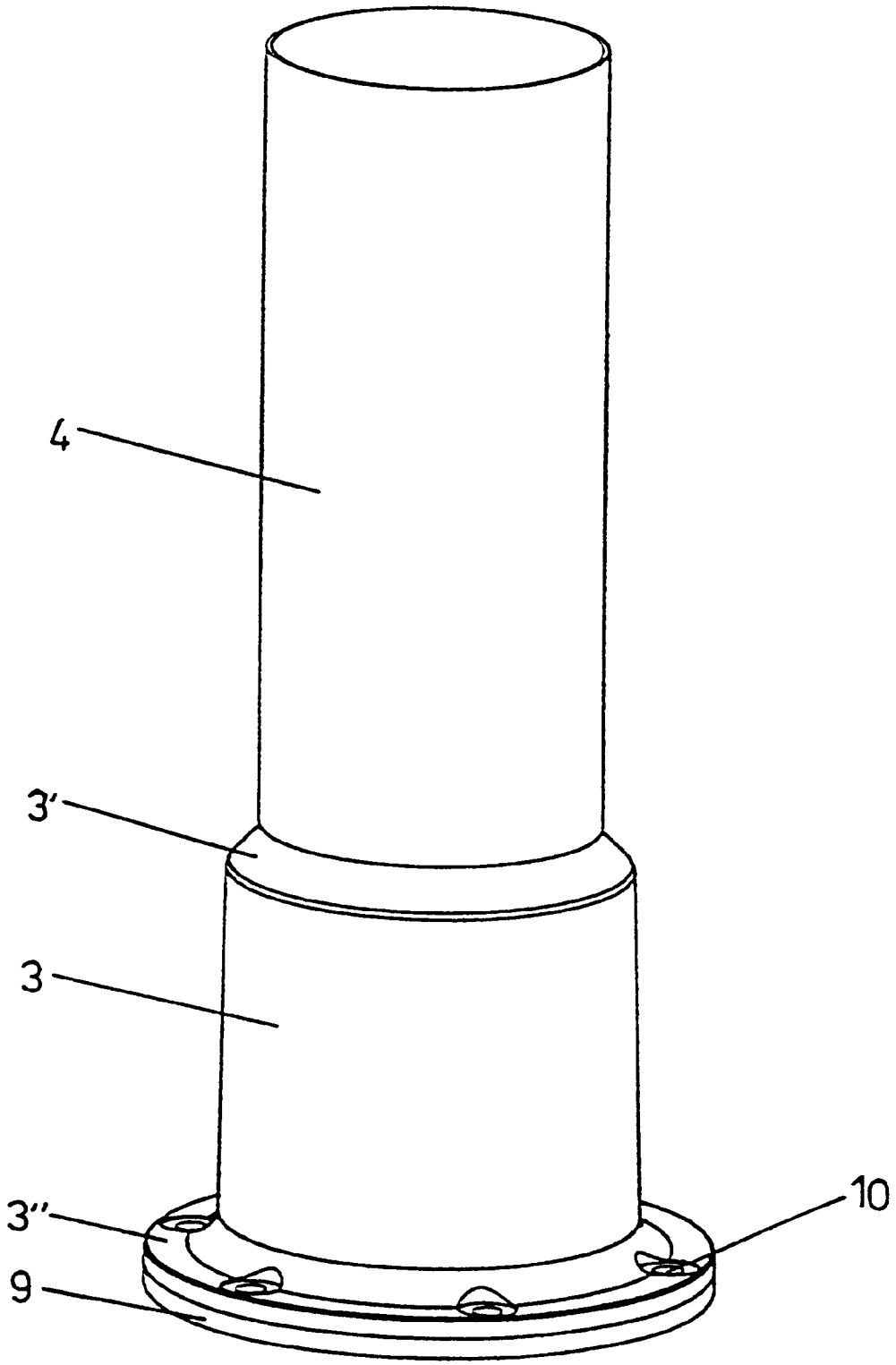
Figure 4:
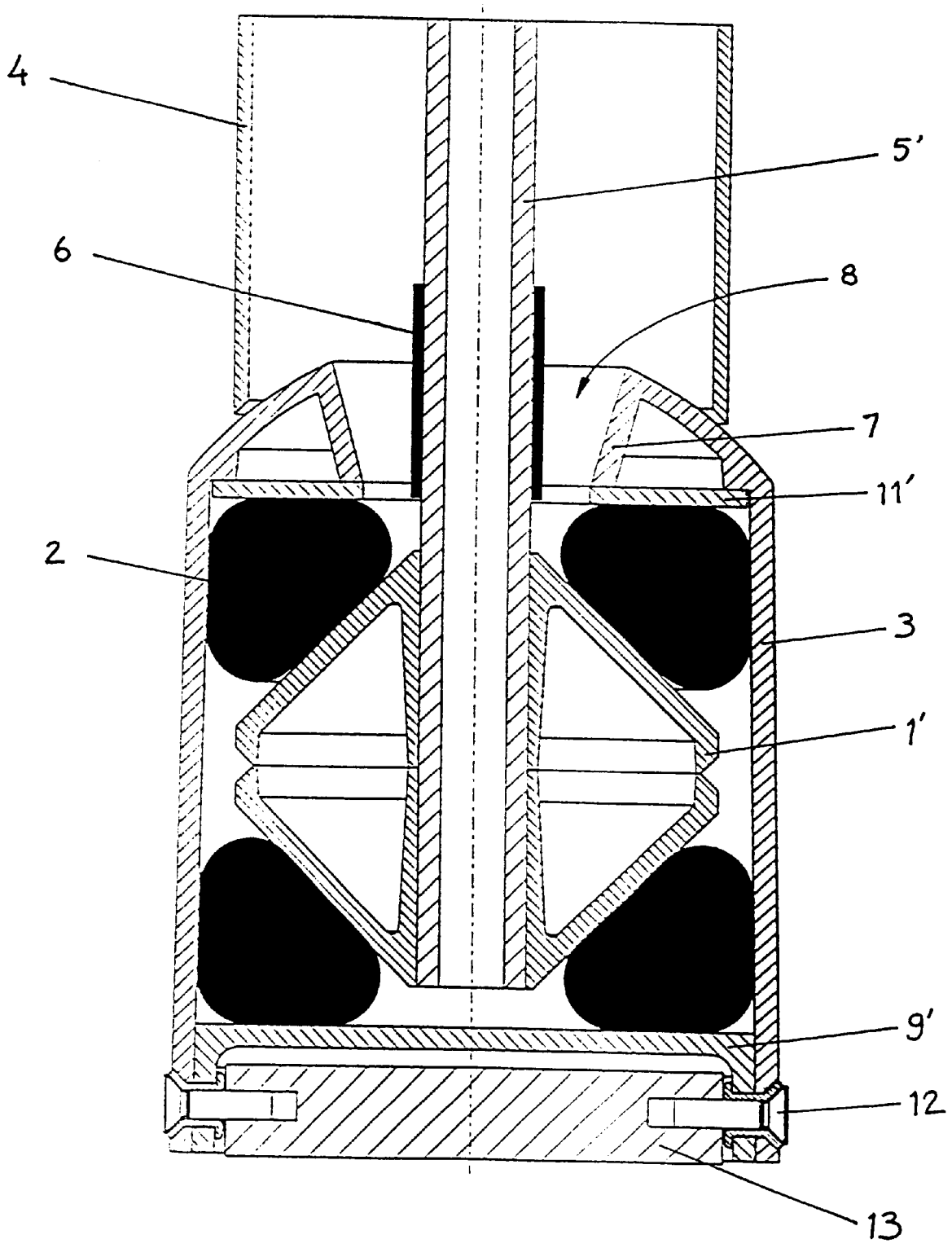
Figure 5:
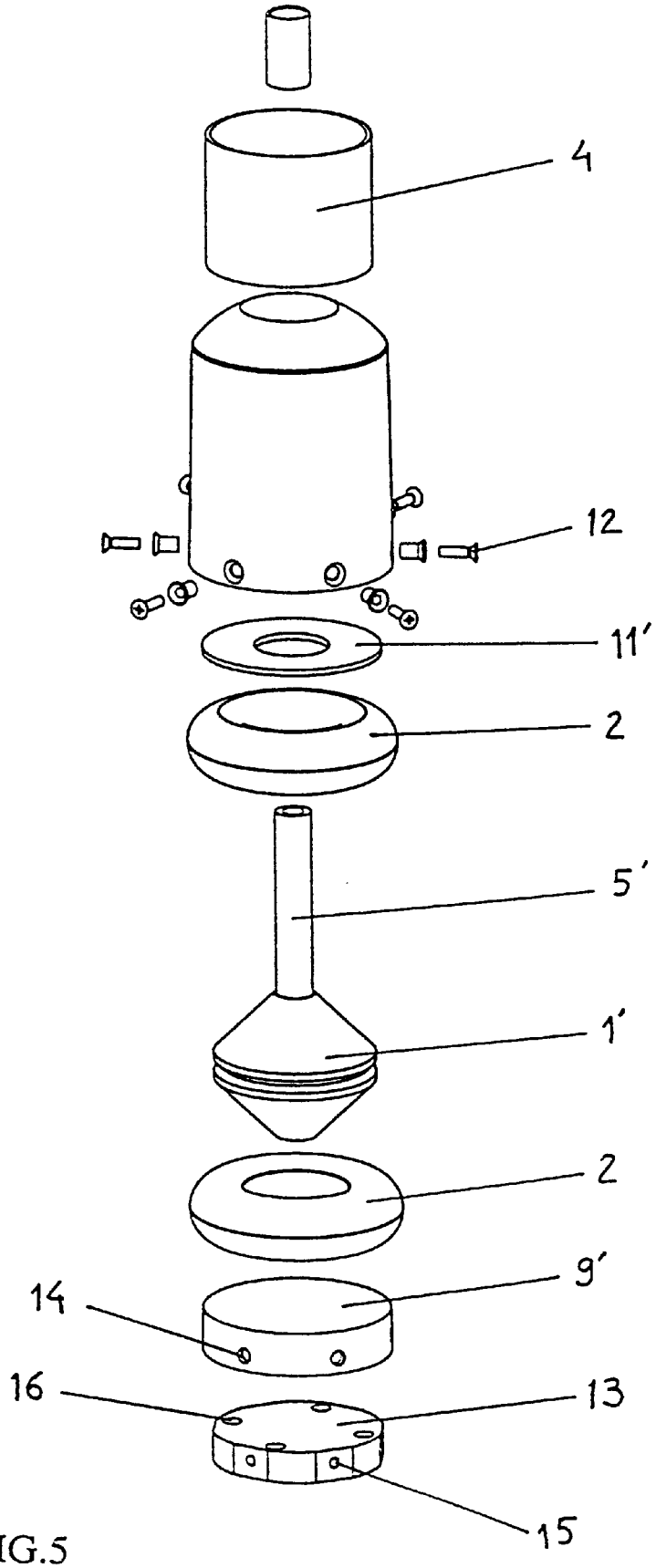
Figure 6:
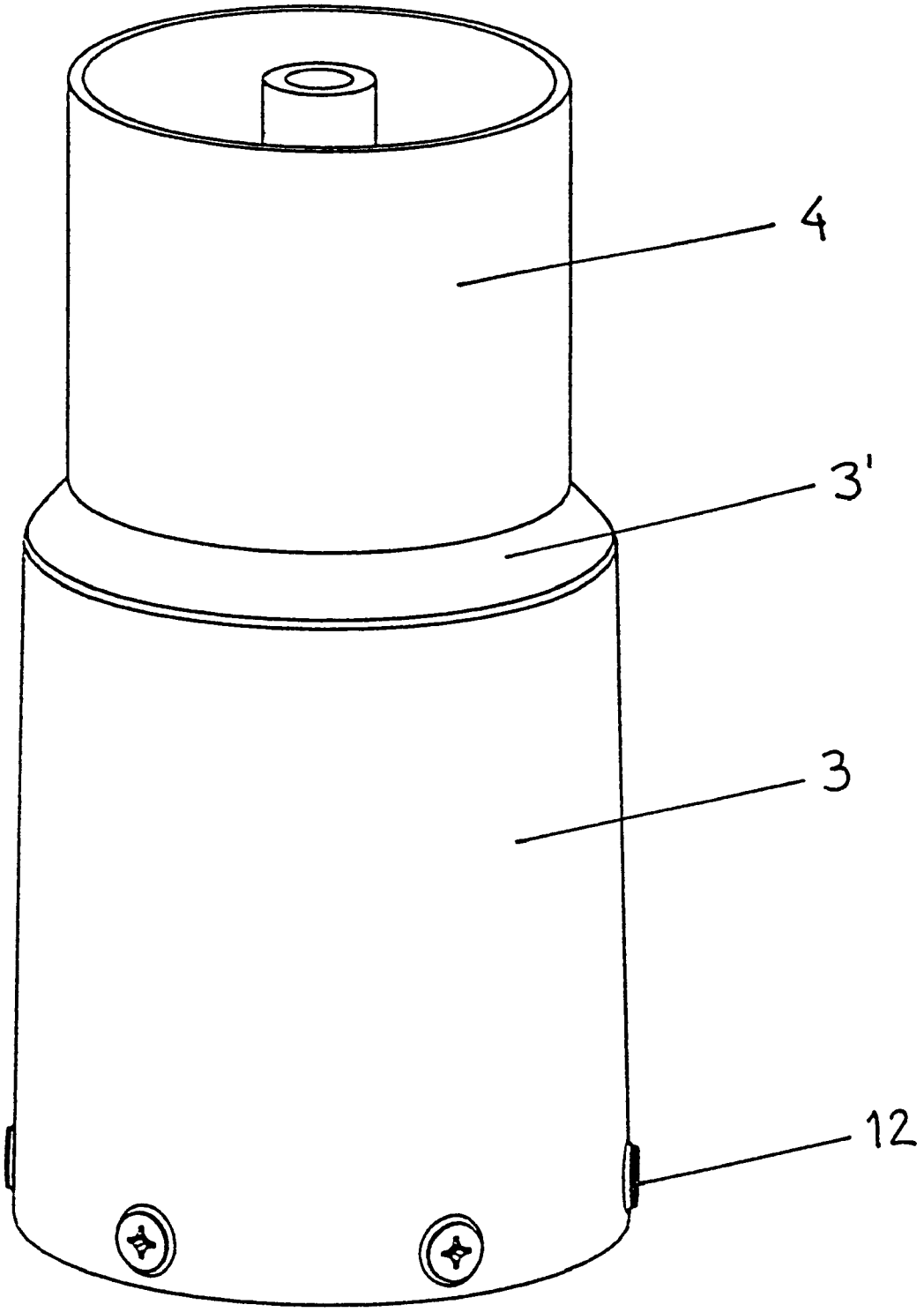

In the specification below, the invention is illustrated with reference to the appended drawings, wherein FIG. 1 illustrates a spring articulation structure according to the invention, seen in a side-view cross section, FIG. 2 gives an exploded view of the spring articulation structure according to FIG. 1, FIG. 3 shows the spring articulation structure according to FIG. 1 as assembled, FIG. 4 illustrates a spring articulation structure according to another preferred embodiment of the invention, seen in a side-view cross section, FIG. 5 gives an exploded view of the spring articulation structure according to FIG. 4, and FIG. 6 shows the spring articulation structure according to FIG. 4 as assembled.

The spring articulation structure according to the invention comprises a core element 1, 1', which is fitted and supported in between two preferably prestretched rubber rings 2. In form, the core element is for instance a piece that is created when two truncated cones with an equal bottom diameter are placed against each other bottom by bottom. The bottoms can be in direct contact with each other, or in between them, there can be inserted a cylindrical element with the same diameter, as is illustrated in FIGS. 1 and 4. In this preferred embodiment, the rubber rings 2 are fitted symmetrically over both cones. Some other suitable form for the core element also is possible.

To the core element, there is permanently attached a shaft element 5, 5', and the play, fitness training or sports instrument in question can be attached at the other end of said shaft element. If the core element is formed of two truncated cones that are placed against each other, the shaft element 5, 5' is attached axially in the middle of the cones, in parallel to the axis of rotation of the cones. The shaft element 5 can be attached on top of the topmost cone of the core element 1, as is the case in FIG. 1, or the shaft element 5' can constitute the axis of the core element 1', as is the case in FIG. 4. The core element and the shaft element can be made to form one uniform piece, in which case a maximum strength and durability are achieved. Advantageously the material of the core and shaft elements is metal, for example stainless steel. Both the core and shaft elements can be hollow pieces, as is the case in FIGS. 1 and 4.

The core element 1 complete with the shaft element, as well as the rubber rings 2, are surrounded by a cylindrical shell 3. In the embodiment according to FIGS. 1–3, the shell 3 includes a flange 3" provided with fastening holes 10. By means of the flange 3", the shell 3 can be fastened to the bottom plate 9, which is provided with holes in places matching to the fastening holes 10 of the flange. In addition, by means of said fastening holes, the spring articulation as a whole can be fastened to an even base.

The inner diameter of the shell 3 is somewhat smaller than the outer diameter of the rubber ring 2, so that when the rubber rings 2 and the core element 1 are placed compactly inside the shell 3, there is created a preliminary tension in the rubber rings 2. The lower rubber ring is supported against the bottom plate 9. Advantageously the rubber rings 2 are similar, and their diameter is so large that when they are arranged in place around the core element, the core element 1 does not touch the inner surface of the shell 3 in any place, advantageously not even when the spring articulation is under strain. The upper rubber ring 2 is from above supported against an essentially horizontal wall 11 formed in the top part 3' of the shell 3.

In another preferred embodiment of the invention, illustrated in FIGS. 4–6, the bottom edge of the shell 3 is straight, and it is provided with fastening holes in order to attach the shell bottom plate 9' in place. The edges of the bottom plate 9' are turned downwardly at an angle of 90 degrees and provided with holes 14 in places matching with those of the holes provided in the bottom edge of the shell 3. Thus there is created a recess under the bottom plate 9', as is seen in FIG. 4. In this recess, there can be inserted for instance a head of a pole, which in FIGS. 4 and 5 is illustrated as a cylindrical disc 13. By means of holes 15 made in said disc 13, the spring articulation structure can be fastened, through the fastening holes provided at the bottom edge of the shell 3 and in the bottom plate 9', for example by hollow rivets 12. The cylindrical disc 13 can also be bolted to the base through holes 16 made therein.

In similar fashion as in the embodiment of FIG. 1, the lower rubber ring 2 is supported against the bottom plate 9'. The upper rubber ring 2 is from above supported against an essentially horizontal wall 11' formed in the top part of the shell 3. The wall 11' can be a separate ring, provided in the middle with a hole for the shaft element 5', the outer diameter of said ring being essentially equal to the inner diameter of the shell 3, so that the wall ring 11' is suitably matched inside the shell 3 and supported against the upwardly narrowing top part 3' of the shell.

The shell and the bottom plate can also be fastened together by some other means than those described above. Advantageously the fastening between the shell and the bottom plate is, however, easily opened for any maintenance operations possibly required by the spring articulation structure.

In the top part 3' of the shell 3, in the middle thereof, there is formed a downwardly narrowing conical aperture 8, through which the shaft element 5, 5' is pushed out of the shell 3. The conical surface 7 of said aperture forms part of the top part 3' of the shell. The diameter of the aperture 8 and the angle of inclination of the cone surface 7 are defined according to the desired inclination allowed for the play, fitness training or sports instrument in question, because when inclining the instrument to the maximum position of inclination, the shaft element 5, 5' touches the conical surface 7 of the aperture 8. Therefore around the shaft element 5, 5', there is fitted, essentially at the cone surface 7, a rubber collar 6, which constitutes a bumper attenuation together with the cone surface. When the shaft element is inclined when using the instrument, the core element 1, 1' connected thereto is pressed against the rubber rings 2, which spring elastically inside the shell 3.

On top of the top surface of the shell 3, there rests a cylindrical element 4 surrounding the shaft element 5, 5', the top part of said element 4 being attached to the shaft element. The diameter of the cylindrical element 4 is larger than the diameter of the aperture 8, at least so much larger that it covers the whole aperture 8. In form, the top surface of the top part 3' of the shell is such that the edge located adjacent to the aperture 8 is placed higher up than the outer edge thereof, in which case the cylindrical element 4 is set compactly on top of the top part of the shell and forms a protecting unit together with the top surface of the shell 3, thus preventing fingers and other body parts, objects and garments from getting in the space located between the shaft element 5, 5' and the cone surface 7 of the shell 3. Advantageously the top part of the shell is rounded to be convex, so that the bottom edge of the cylindrical element 4, placed on top of the convex part, can move along the convex surface when the shaft element 5, 5' is inclined, so that the cylindrical element 4 does not restrict the motions of the shaft element or of the instrument attached thereto. Moreover, the convex top surface of the shell is designed so that the clearance in between the shell and the cylindrical element grows as a function of the rocking angle, by means of which arrangement the body parts are prevented from being caught in between.

Both the shell and the cylindrical element 4 are advantageously made of metal, for example stainless steel, but they can also be made of plastic. The cylindrical element can be split in the lengthwise direction, in which case it can be drawn on top of the shaft element even after the play, fitness training or sports instrument in question is attached to the shaft element 5, 5' .

FIGS. 2 and 5 illustrate how simple it is to assemble the spring articulation structure according to the invention. On top of the bottom plate 9, 9', there is first placed the first rubber ring 2, then the core element 1, 1' including the shaft element 5, 5', and the second rubber ring 2. On top of these, there is fitted the shell 3, which is fastened to the bottom plate 9, 9'. FIG. 5 also illustrates the separate annular wall part 11' to be placed on top of the second rubber ring 2, which in the embodiment of FIG. 2 forms part of the top part 3' of the shell. Around the shaft element 5, 5' protruding from the aperture provided in the top part 3' of the shell, there is set the protecting cylindrical element 4. When fully installed, the structure is safe, because all moving parts are hidden under the shell and the cylindrical element 4, as is seen in FIGS. 3 and 6. When necessary, the structure can be assembled simply on site, on the playground, and the maintenance can be carried out on site as well.

In the above specification, we have described a few preferred embodiments of the invention. Naturally the invention is not restricted to the examples given above, but the principle according to the invention can be modified within the scope of protection defined in the appended claims.

What is claimed is:

1. A spring articulation structure for play, fitness training and sports instruments, said spring articulation structure comprising a core element supported by and between two elastic springs in the form of two rubber rings, a shaft element fitted to said core element, and a shell compactly surrounding said core element and said rubber rings, said shell connected to a bottom plate, and having a top part defining an aperture having a downwardly narrowing conical surface for movably supporting the shaft element, wherein said elastic springs in the form of two rubber rings are configured and adapted to support said shaft element in a rest position, and to provide a free and flexible rocking motion in any direction to said core element and said shaft element by compressing when said shaft element is displaced in a first direction from said rest position, thereby providing a first force on said core element in a second direction, such that upon release of said shaft element, said first force provided by said two rubber rings accelerates said core element in said second direction, displacing said shaft element back to and beyond said rest position, compressing said rubber rings to produce a second force on said core element that slows, stops, and changes the motion of the shaft element, thereby causing movement of said shaft element to repeat, providing the desired free and flexible rocking motion.

2. The spring articulation structure of claim 1 wherein the rubber rings are prestretched.

3. The spring articulation structure of claim 1 wherein the top surface of the top part of the shell is convex.

4. The spring articulation structure of claim 1 wherein the conical surface for supporting the shaft element is substantially surrounded by rubber.

5. The spring articulation structure of claim 1, wherein the core element comprises a first truncated cone and a second truncated cone, each having a bottom, and said first and second truncated cones are set against each other bottom to bottom, either directly or separated by an element.

6. The spring articulation structure of claim 1, wherein the shell comprises a flange provided with fastening holes, by means of which flange the shell is fastened to the bottom plate.

7. The spring articulation structure of claim 1 wherein the bottom edge of the shell is provided with fastening holes whereby the shell is fastened to the bottom plate, the edges of the bottom plate being turned downwardly at an angle of 90 degrees and being provided with holes at places matching the holes in the bottom edge of the shell.

8. The spring articulation structure of claim 1 wherein the rubber rings are similar to each other and their diameter is sufficiently large so that when the rings are drawn around the core element, the core element does not touch the inner surface of the shell when the spring articulation structure is under strain.

9. The spring articulation structure of claim 1 wherein the diameter of the aperture and the angle of inclination of the conical surface are defined according to how large is the inclination that is desired to be allowed for the play, fitness training or sports instrument in question.

10. The spring articulation structure of claim 1 wherein on the top of the top part of the shell, there is provided a cylindrical element surrounding the shaft element.

11. The spring articulation structure of claim 10 wherein the diameter of the cylindrical element is larger than the diameter of the aperture, so that 1 covers the aperture (8).

12. The spring articulation structure of claim 1 wherein the shell, the core element, the shaft element and the cylindrical element are comprised of metal.

13. The spring articulation structure of claim 10 wherein the shell, the core element, the shaft element and the cylindrical element are comprised of metal.

14. The spring articulation structure of claim 1 wherein the shell, the core element, the shaft element and the cylindrical element are comprised of stainless steel.

15. The spring articulation structure of claim 10 wherein the shell, the core element, the shaft element and the cylindrical element are comprised of stainless steel.

16. The spring articulation structure of claim 5, wherein said first and second truncated cones of the core element each has a bottom having a diameter, and said two truncated cones are connected by a cylindrical core element.

17. The spring articulation structure of claim 16, wherein said diameter of said bottom of said first truncated cone is substantially the same as said diameter of said bottom of said second truncated cone.

* * * * *